US011313201B1

(12) United States Patent
Harms

(10) Patent No.: US 11,313,201 B1
(45) Date of Patent: Apr. 26, 2022

(54) WELL SEALING TOOL WITH CONTROLLED-VOLUME GLAND OPENING

(71) Applicant: Halliburton Energy Services, Inc., Houston, TX (US)

(72) Inventor: Timothy Edward Harms, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/081,002

(22) Filed: Oct. 27, 2020

(51) Int. Cl.
*E21B 33/128* (2006.01)
*E21B 33/12* (2006.01)

(52) U.S. Cl.
CPC ..... *E21B 33/128* (2013.01); *E21B 33/12* (2013.01); *E21B 33/1208* (2013.01)

(58) Field of Classification Search
CPC .... E21B 33/128; E21B 33/1208; E21B 33/34; E21B 33/12
See application file for complete search history.

(56) References Cited

U.S. PATENT DOCUMENTS

| | | | | |
|---|---|---|---|---|
| 2008/0023193 | A1* | 1/2008 | O'Brien ..... | E21B 33/1208 166/179 |
| 2012/0205117 | A1 | 8/2012 | Harms | |
| 2014/0151025 | A1 | 6/2014 | Harms et al. | |
| 2014/0151070 | A1 | 6/2014 | Harms et al. | |
| 2014/0166306 | A1 | 6/2014 | Harms | |
| 2014/0166318 | A1 | 6/2014 | Harms | |
| 2015/0068771 | A1 | 3/2015 | Richards et al. | |
| 2015/0068772 | A1 | 3/2015 | Richards et al. | |
| 2015/0167424 | A1 | 6/2015 | Richards et al. | |
| 2016/0010421 | A1 | 1/2016 | Henderson et al. | |
| 2016/0123093 | A1 | 5/2016 | Richards et al. | |
| 2016/0153248 | A1 | 6/2016 | Richards et al. | |
| 2016/0273290 | A1 | 9/2016 | Harms | |
| 2018/0128074 | A1 | 5/2018 | Henderson et al. | |

FOREIGN PATENT DOCUMENTS

| | | |
|---|---|---|
| EP | 2495393 | 9/2012 |

OTHER PUBLICATIONS

Halliburton, Swell Technology Systems for Well Construction, H011837, Jul. 2015.
Halliburton, HERO™ Bridge Plug, High-Performance, High-Expansion Retrievable Monobore Plugging Device, H012636, Feb. 2020.

* cited by examiner

*Primary Examiner* — Yong-Suk (Philip) Ro
(74) *Attorney, Agent, or Firm* — Scott Richardson; C. Tumey Law Group PLLC

(57) ABSTRACT

A downhole sealing tool may include a sealing element disposed on a mandrel for lowering into a well. The sealing element may be captured at the ends between the mandrel and a shroud and may span a gland opening between upper and lower shroud portions. Props between the mandrel and the shroud are axially moveable to engage the sealing element and urge the sealing element radially outwardly into a controlled volume defined at the gland opening between the mandrel and a portion of the well to be sealed. A higher squeeze ratio is achievable, allowing for a thinner element and tool profile with greater flowability.

20 Claims, 6 Drawing Sheets

| Packer Element Comparison | | |
|---|---|---|
| Parameters | Element 1 | Element 2 |
| Mandrel OD | 4.55" | 4.55" |
| Casing ID | 6.25" | 6.25" |
| Element OD | 5.8" | 5.3" |
| Element Volume | 42 $in^3$ | 42 $in^3$ |
| Area b/t Element OD & Casing ID | 4.26 $in^3$ | 8.62 $in^3$ |
| Length Run | 4.133" | 7.238" |
| Length Set | 2.912" | 2.912" |
| Percent Squeeze Required to Seal | 29.50% | 59.70% |

WELL SEALING TOOL WITH CONTROLLED-VOLUME GLAND OPENING

BACKGROUND

Wells are drilled into subterranean formations to retrieve hydrocarbons such as oil and gas. A well and the profile of tools used in drilling and completing the wells are often circular. Because efforts are made to control the flow of fluids used in drilling wells and hydrocarbon fluids produced, it is often necessary to seal between tool components and/or between components and the well. In many instances, for example, it is desirable to divide a subterranean formation into zones and to isolate those zones from one another in order to prevent cross-flow of fluids from the rock formation and other areas into the annulus. It may also be desirable to control sand across multi-zone applications.

A packer is an example of a tool having one or more sealing elements that may be lowered into a well on a mandrel and expanded into sealing engagement with an open-hole wellbore or a well component such as casing. For example, a packer may be used to seal between a completion string and wellbore casing. The packer may include a wedge/slip system to help hold the completion string in place. A packer may be used for any of a variety of situations requiring a seal, such as to isolate zones to be gravel packed and produced separately. Without such devices, the zone may experience problems such as sand production, erosion, water breakthrough, or other detrimental problems. For example, a packer may be used to support a screen adjacent to a producing formation and to seal the annulus between the outside of the completion string and the inside of the wellbore casing. This blocks movement of fluids through the annulus past the packer.

The sealing element may have a degree of compliancy and may be expanded radially outwardly into engagement with the sealing surface by compressing it axially. One measure of compliancy is the acceptable squeeze ratio (alternately referred to as "percent squeeze" and variants thereof). Percentage squeeze is a measurement of ratio between the length of the element in its relaxed state, such as when run into the well, and the length of the element in the expanded state, such as when set into engagement with the casing or other wellbore feature.

Conventional sealing elements start becoming unstable at a certain squeeze ratio, above which the element may become unstable or fail, such as by deploying in an unpredictable/unreliable manner and possibly overlapping on top of itself. Other sealing systems, inflatable, swell, and cup packers are typically used in low pressure applications unless stacked or made longer to choke down the pressure. While capable of bridging an extrusion gap (i.e., an unsupported gap between an ID of the casing and OD of a mandrel), most of these have low pressure ratings and the amount of compression is very limited. Other sealing elements such as certain bridge plug have greater expansion, but this is in part because the inner diameter (ID) of the element is significantly less than other designs.

BRIEF DESCRIPTION OF THE DRAWINGS

These drawings illustrate and support aspects of the present disclosure in the context of certain examples, but should not be used to limit or define the method to only those examples.

DETAILED DESCRIPTION

Sealing tools and methods are disclosed for use in a wellbore. Aspects of this disclosure are discussed in the context of packers, but may be applied to other wellbore sealing tools and applications. In one aspect, the sealing element is expanded outwardly into a controlled-volume gland opening defined between axially-spaced shrouds. The volume and length of the gland opening into which the element expands may remain constant during expansion. By expanding the sealing element into a controlled volume gland, any potential for buckling variations during element deployment should be reduced. As a result, a greater percentage squeeze may be achieved for a given element thickness. This may allow for a slimmer tool profile with greater flow area between the sealing tool and the wellbore, and/or greater expansion with less material.

In example configurations, the sealing element is captured at its ends between a mandrel and axially-spaced shrouds. A dual prop and piston arrangement is provided for expanding the element, to help achieve high element expansion and a high-pressure sealing with minimal hydraulic setting force. Axial engagement of the sealing element causes it to expand radially outwardly into the controlled-volume gland opening. Expansion may be facilitated by optionally wedging the props between the mandrel and sealing element to urge the sealing element toward the casing or other feature to be sealed. Deployment characteristics of the sealing element can be further enhanced by using multi durometer element material, under cuts in the element to aid in buckling, and garter springs, fillers, and/or or mesh materials embedded in the element material to manipulate the shape and timing of the deployment sequence.

Figure 1:
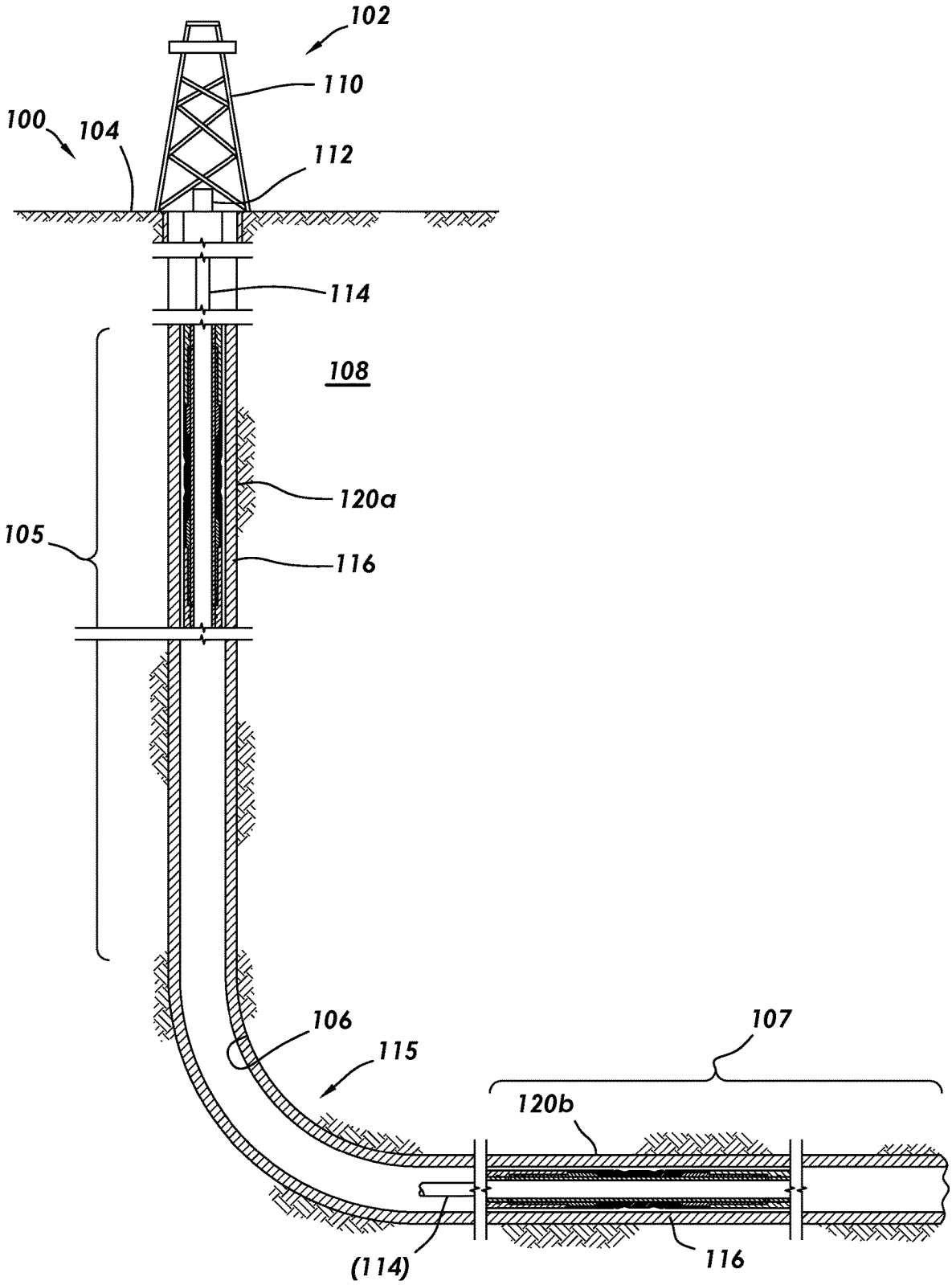
FIG. 1 is a schematic, elevation view of a well system in which one or more sealing tools (e.g. a packer) according to the disclosure may be deployed.

FIG. 1 is a schematic, elevation view of a well system 100 as an example environment in which one or more sealing tools e.g., packers 120*a*, 120*b* may be deployed to seal along a wellbore 106. The wellbore 106 traverses a subterranean earth formation 108 in pursuit of hydrocarbons such as oil and gas. The well system 100 may include an oil and gas rig 102 arranged at the earth's surface 104 above the wellbore 106. The rig 102 may include a large support structure such as a derrick 110, erected over the wellbore 106 on a support foundation or platform, such as a rig floor 112. Even though certain drawing features of FIG. 1 depict a land-based oil and gas rig 102, it will be appreciated that the embodiments of the present disclosure are useful with other types of rigs, such as offshore platforms or floating rigs used for subsea wells, and in any other geographical location. For example, in a subsea context, the earth's surface 104 may be the floor of a seabed, and the rig floor 112 may be on the offshore platform or floating rig over the water above the seabed. A subsea wellhead may be installed on the seabed and accessed via a riser from the platform or vessel.

The wellbore 106 may extend through the various earth strata including formation 106. The wellbore 106 may be drilled according to a wellbore plan to reach one or more target formations, to avoid non-desirable formation features, to minimize footprint of the well at the surface, and to achieve any other objectives for the well. The wellbore 106 may follow a chosen path (i.e., the wellbore path) from where the wellbore 106 is initiated at the surface 104 (i.e., the "heel") to the end of the well (i.e., the "toe"). The initial portion of the wellbore 106 is typically vertically downward as the drill string would generally be suspended vertically from the rig 102. Thereafter the wellbore 106 may deviate in any direction as measured by azimuth or inclination, which may result in sections that are vertical, horizontal, angled up or down, and/or curved. The term uphole generally refers to a direction along the wellbore path toward the surface 104 and the term downhole generally refers to a direction toward the toe at the end 105 of the well, without regard to whether a feature is vertically upward or vertically downward with respect to a reference point. The wellbore path in FIG. 1 is simplified for ease of illustration, and is not to scale. In this example, the wellbore path includes an initial, vertical section 105, followed by at least one deviated section 115 downhole of the vertical section 105, which transitions from the vertical section 105 to a horizontal or lateral section 107 downhole of the curved section 115. Thus, the vertical section 105 is uphole of the curved section 115 and lateral section 107.

The wellbore 106 may be at least partially cased with a casing string 116 at selected locations within the wellbore 106, while other portions of the wellbore 106 may remain uncased. The casing string 116 may be secured within the wellbore 106 using cement. In other embodiments, the casing string 116 may be only partially cemented within the wellbore 106 or, alternatively, the casing string 116 may be entirely un-cemented. The casing 116 may be made from any material such as metals, plastics, composites, or the like, may be expanded or unexpanded as part of an installation procedure. Production tubing may be any suitable tubing string utilized in the production of hydrocarbons. In examples, production tubing may be permanently disposed within casing 116. The packers 120*a*, 120*b* may be disposed on or near production tubing.

The rig 102 may include a hoisting apparatus for raising and lowering equipment from the rig 110 on a conveyance 114. The conveyance 114 may serve various functions, such as to lower and retrieve tools, to convey fluids, and to support electrical communication, power, and fluid transmission during wellbore operations. Conveyance 114 may include any suitable equipment for mechanically conveying tools such as the packers 120*a*, 120*b* and any suitable packer setting assembly for setting the packers 120*a*, 120*b*. Such conveyance may include, for example, a tubular string made up of interconnected tubing segments, or wireline, slickline, coiled tubing, or any combination of any of the foregoing. In some examples, conveyance 114 may provide mechanical suspension, as well as electrical and fluidic connectivity, for downhole tools like the packers 120*a*, 120*b*. The conveyance 114 may be used to lower one or more tools into the wellbore 106, i.e. run/tripped into the hole. When a wellbore operation is complete, or when it becomes necessary to exchange or replace tools or components of the conveyance 114, the conveyance 114 may be raised or fully removed from the wellbore 106, i.e., tripped out of the hole. The packers 120*a*, 120*b* are examples of downhole tools that may be deployed on the conveyance 114. The packers 120*a*, 120*b* may be actuated at selected locations to seal off a portion of the wellbore 106.

One or more packers or other sealing tools according to this disclosure may be set for any of a variety of sealing purposes. As depicted in FIG. 1, the two packers 120*a*, 120*b* may represent the same packer being tripped down the wellbore 106 at two different checkpoints. For example, the location at 120*a* may represent the packer as it is being deployed in a run-in condition through the vertical section 105, and the location at 120*b* may represent the same packer after is has been deployed further down into the lateral section 116 and set. Alternatively, the packers 120*a*, 120*b* may represent two different packers to be deployed to different locations in the wellbore 106. For example, the second packer 120*b* may be a packer that has already been deployed and set in the lateral section 107 of the wellbore 106, and the first packer 120*a* may be another packer deployed to the vertical section 105 but has not yet been set.

A variety of packer types may be configured according to this disclosure, including but not limited to production packers and service packers. Suitable types of packers may include whether they are permanently set or retrievable, mechanically set, hydraulically set, and/or combinations thereof. As just one example, the packers 120*a* and/or 120*b* may be production packers that will remain in the well during well production. Alternatively, the packers 120*a* and/or 120*b* may be service packers used temporarily during well servicing, such as cementing, acidizing, or fracturing. When set, packer 120 may isolate zones of the annulus between wellbore 106 and a tubing string by providing a seal between production tubing and casing 116. In examples, a packer may be disposed on production tubing. Downhole setting tools may also be disposed on the conveyance 114 and run into wellbore 106 for actuating the packers 120*a*, 120*b*.

Figure 2:
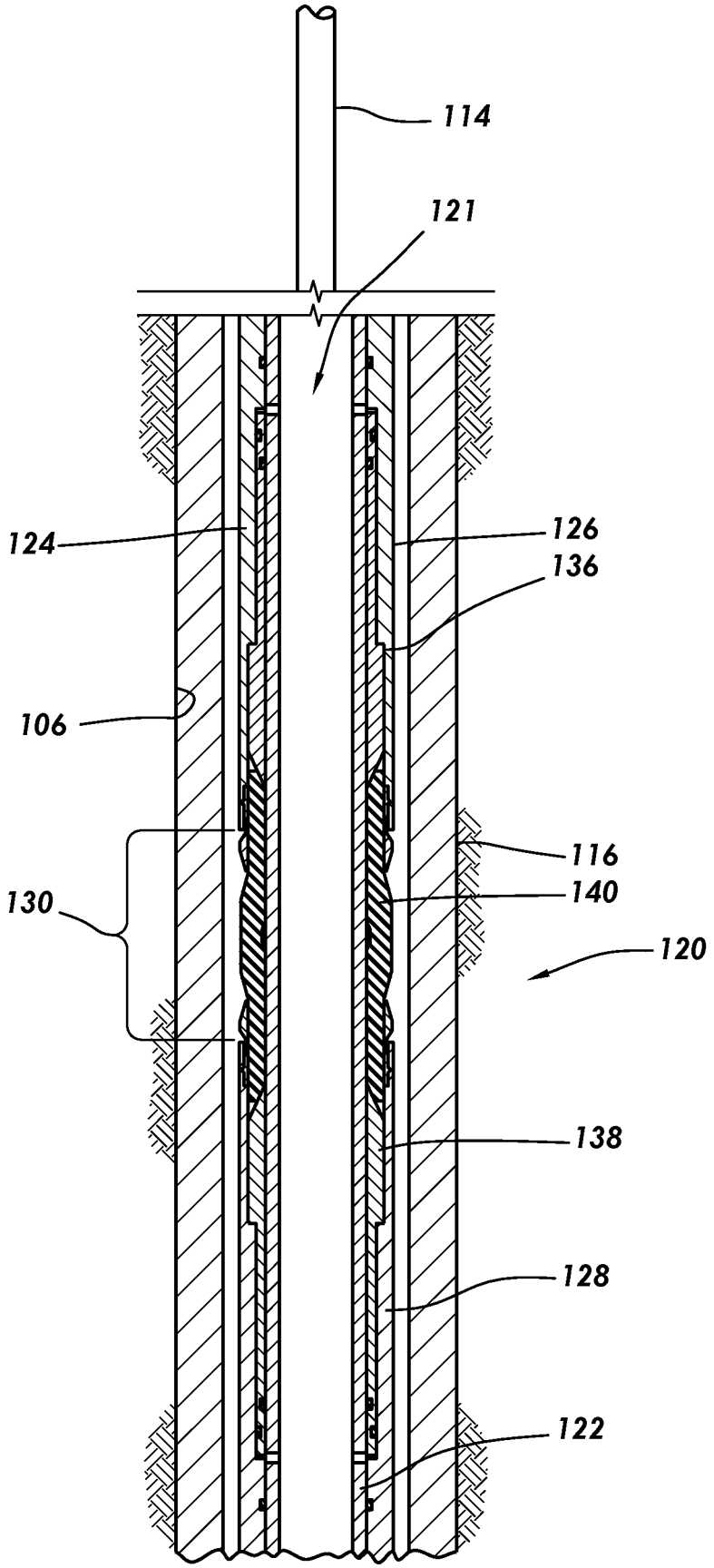
FIG. 2 is an enlarged view of the packer of FIG. 1.

FIG. 2 is an enlarged view of one of the packers 120 of FIG. 1 being deployed into the wellbore 106 in a run-in condition, wherein the sealing element 140 is unexpanded while it is tripped downhole prior to set. The casing 116 is tubular in shape to conform to the generally circular profile of the wellbore 106 having been drilled with a rotary drill bit. Likewise, the packer 120 has a generally circular outer profile, to fit within the generally tubular profile of the wellbore 106 as it is tripped downhole, and to conform with the casing 116 when set. The packer 120 includes a mandrel 122 coupled to a conveyance 114 for lowering the packer 120 into the well. The mandrel 122 has an internal fluid passage ("bore") 121 for internally conveying fluids. The mandrel 122 also supports one or more other packer components including the sealing element 140. The mandrel 122 has a generally circular cross-sectional profile. The various other packer components mounted radially external to the mandrel 122 may also have circular cross-sections that may vary along the axial direction of the mandrel 122. The other packer components include, for example, a shroud generally indicated at 124. Shroud 124 includes upper and lower shroud portions 126, 128 axially spaced along the mandrel 122. A gland opening 130 is defined between the upper and lower shroud portions 126, 128 through which the sealing element 140 may be expanded. The sealing element 140 is captured at opposing ends between the mandrel 122 and the respective shroud portions 126, 128, with the sealing element 140 spanning the gland opening 130.

To achieve high element expansion and a high-pressure sealing system with minimal hydraulic setting force, the sealing element may be deployed outwardly by expanding it over a dual prop and piston arrangement. A pair of opposing props 136, 138 are radially disposed between an OD of the mandrel 122 and the shroud 124. The props 136, 138 are axially moveable toward one another to selectively engage the sealing element 140 in order to urge the sealing element 140 outwardly through the gland opening 130 into sealing engagement with an inner diameter (ID) of the casing 116.

Figure 3:
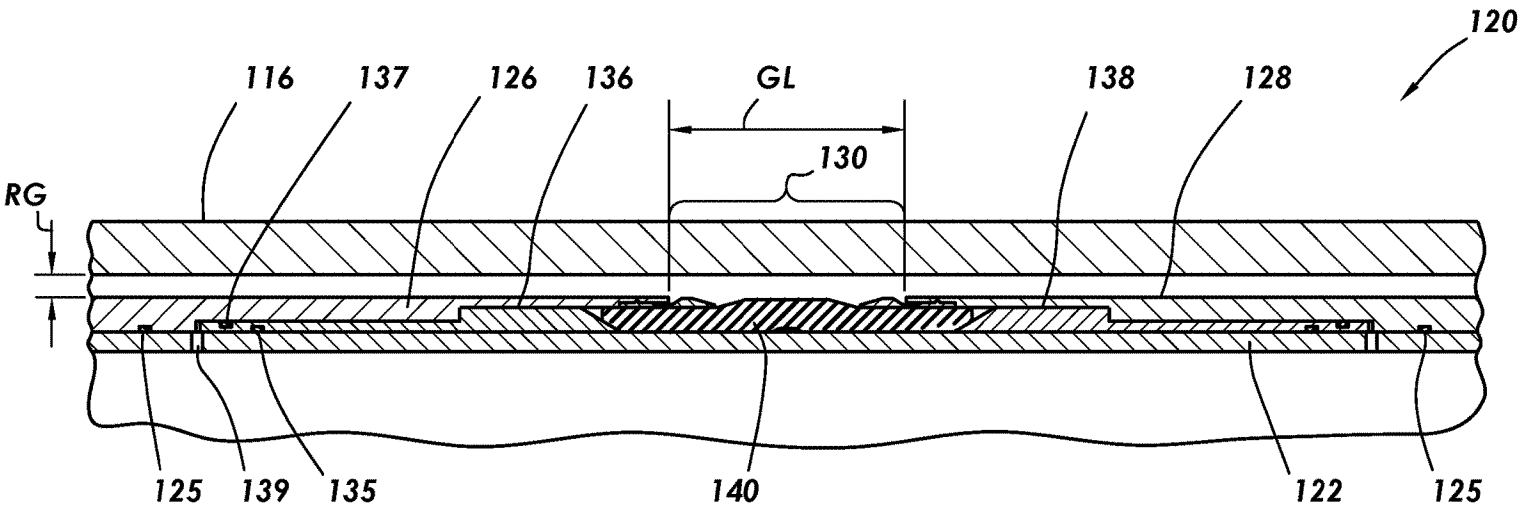
FIG. 3 is an enlarged view of the packer in the run-in condition.

FIG. 3 is an enlarged detailed view of a portion of the packer 120 (rotated 90 degrees from FIG. 2), still in the run-in condition. In the run-in condition, the outermost exposed portion of the sealing element 140 along the gland opening 130 remains flush with, or at least slightly radially inward of, an outer diameter (OD) of the shroud portions 126, 128. A radial gap labeled "RG" is present between the OD of the shroud portions 126, 128 and an ID of the casing 116. The presence of the gap RG facilitates tripping the packer 120 downhole into and/or through various features the casing 116, without getting stuck in the casing 116 prior to being set. The gap RG also allows any incidental fluid flow around the packer 120 as it is tripped downhole. Because the sealing element 140 is flush or receded, the sealing element 140 is not expected to appreciably interfere with this flow. This reduces the potential for accidental deployment of the element package (swab off) due to fluid circulating over the element(s), which can otherwise occur by pumping and or as it is tripped downhole.

In the run-in condition, the opposing props 136, 138 are axially spaced apart along the mandrel 116, such that they do not appreciably expand the sealing element 140. The props 136, 138 may contact the sealing element 140 as shown during run-in, which may help keep the sealing element 140 centered within the gland opening 130 even during a bumpy trip downhole, in addition to any retention provided by the shroud portions 126, 128 at the captured ends of the sealing element 140 between the shroud portions 126, 128 and the mandrel 122.

The shroud portions 126, 128 may be secured to the mandrel 122 at fixed axial locations along the mandrel 122 and sealed with the OD of the mandrel 122 via sealing elements 125. Alternatively, the shroud portions 126, 128 may be axially moveable along the mandrel 122, such as to facilitate installation or replacement of the sealing element 140 onto the mandrel 122, or to configure the packer 120 with a selected one of a plurality of different element sizes. If moveable, the shroud portions 126, 128 may at least be held at fixed positions during use, at least while setting, so that the gland opening 130 may have a fixed and knowable gland length "GL" in the axial direction of the mandrel 122, at least while setting the packer 120. Thus, a controlled volume is defined between the OD of the mandrel 122, the ID of the casing 116, and the gland length GL of the gland opening 130 during setting.

In one aspect, the controlled volume is controlled at least in that it may provide a fixed volumetric constraints for the sealing element 140 to expand into when the props 136, 138 are moved axially inwardly into engagement with the sealing element 140. The controlled volume may be optionally adjusted, by selecting the axial positioning of the shroud portions 126, 128 along the mandrel 122 prior to tripping downhole. The gland length GL may be determined, for example, at the time of assembly of the packer 120. The gland length GL is optionally adjustable in one or more embodiments by adjusting axial positions of the shroud portions 126, 128 along the mandrel, such as mechanically and/or hydraulically, at some point prior to deploying and/or setting the packer in the well. In the case of moveable shroud portions 126, 128, the sealing elements 125 may provide a dynamic seal between the shroud portions 126, 128 and the mandrel 122, and may optionally facilitate operating the shroud portions 126, 128 to control their positions prior to setting the packer 120.

The props 136, 138 are axially moveable along the mandrel 122, between the OD of the mandrel 122 and an ID of the respective shroud portions 126, 128. An inner seal 135 seals between the OD of the mandrel 122 and the props 136, 138. An outer seal 137 seals between each shroud portion 126, 128 and the respective prop 136, 138. A pressure port 139 is provided along the mandrel 122 at the outer end of each prop 136, 138. The pressure ports 139 are in fluid communication with a chamber defined at a radial gap between the mandrel 122 and the respective shroud 126, 128 in which the respective prop 136, 138 is slidably captured. Pressure may be selectively provided to these ports 139 when it is desired to set the packer 120, to urge the props 136, 138 axially into engagement.

Figure 4:
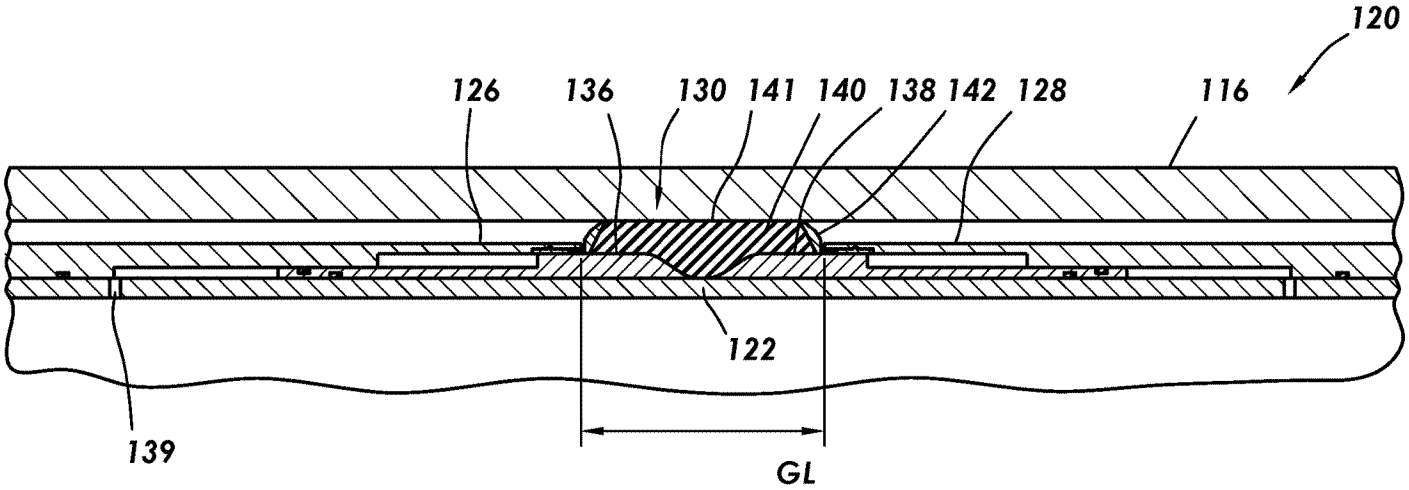
FIG. 4 is an enlarged detailed view of the packer in a set condition.

FIG. 4 is an enlarged view of the packer 120 of FIG. 3 in a set condition, wherein the sealing element 140 has been radially expanded into engagement with the casing 116. To set the packer 120, hydraulic pressure may be supplied to the ports 139 to forcibly drive the props 136, 138 axially toward one another and into engagement with the sealing element 140. The sealing element 140, correspondingly, may be forcibly urged radially outwardly through the gland opening 130 into sealing engagement with the casing 116 as shown in FIG. 4. A pair of backup shoes 142 are optionally included to protect the sealing element 140 from damage by the ends of the shroud portions 126, 128, and/or to help guide expansion of the sealing element 140 outwardly of the gland opening 130. The backup shoes 142 may also provide a barrier between the mandrel 122 and the well bore and help prevent extrusion of the sealing element 140.

The controlled volume of the expanded sealing element 140 is generally indicated in dashed line type at 141. The volume of the expanded sealing element 140 may be further defined by the particular geometry of the packer components and surrounding structure in which it is captured and expanded, such as the geometry of the props 136, 138, a narrow portion of the mandrel 122 between the props 136, 138, backup shoes 142, and the ID of the casing 116. While the precise volume may be subject to that geometry, and other aspects like the amount of force applied by the props 136, 138 and their final axial position along the mandrel 122, the controlled volume is still largely determined and may be approximated by the constraints of the ID of the casing 116, the OD of the mandrel 122, and the gland length GL. (The gland length GL remains constant in this example.) The portion of the sealing element protruding through the gland opening 130 is generally limited by and approximately equal to the gland length GL, although this may differ slightly depending on a variety of parameters such as the element material, packer geometry, and the dynamics of expansion). These known parameters are useful for purposes of computing or approximating a percent squeeze (further discussed below with reference to FIG. 7).

Figure 5:
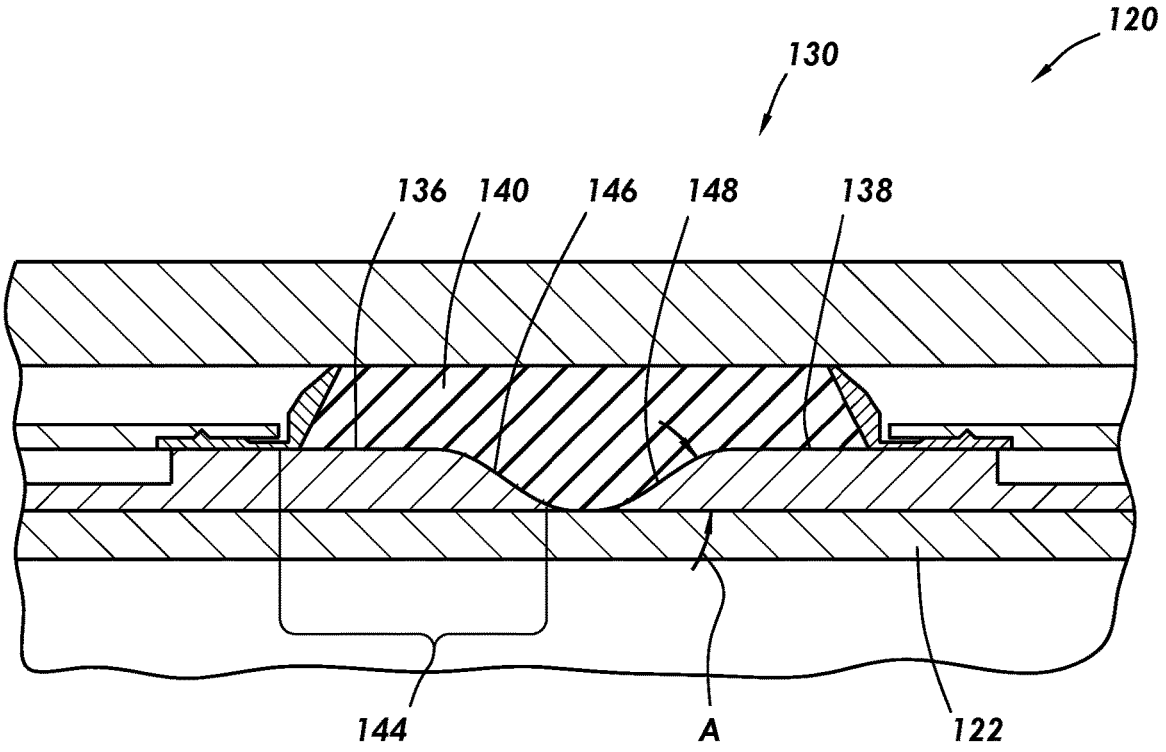
FIG. 5 is an enlarged view of the set packer of FIG. 4, wherein the geometry includes wedge-shaped props in the vicinity of the gland opening.

FIG. 5 is an enlarged view of the set packer of FIG. 4 illustrating certain geometry around the gland opening 130. The props 136, 138 in this example include wedge-shaped ends 146, 148, which are angled radially outwardly to wedge between the mandrel 122 and the sealing element 140. The wedge-shaped ends 146, 148 may wedge between the mandrel 122 and the sealing element 140 to urge at least a portion of the sealing element 140 radially away from the mandrel 122 and into increased sealing engagement with the casing 116 as the props 136, 138 are axially moved toward one another. This example geometry helps expand the sealing element 140 in at least two ways. First, movement of the props 136, 138 squeezes the compliant material of the sealing element 140 in a way that displaces the sealing element 140 outwardly. Second, axial movement of the props 136, 138 toward one another moves some of the material of the sealing element 140 radially away from the mandrel 122 toward the casing 116 with which it is intended to seal. This may facilitate expansion as compared with expanding the sealing element solely by axially compressing the sealing element 140. In this example, the wedge-shaped ends 146, 148 have an angle "A" of approximately 30 degrees. In other embodiments, the angle A may be within a range of between 15 and 45 degrees.

Figure 6:
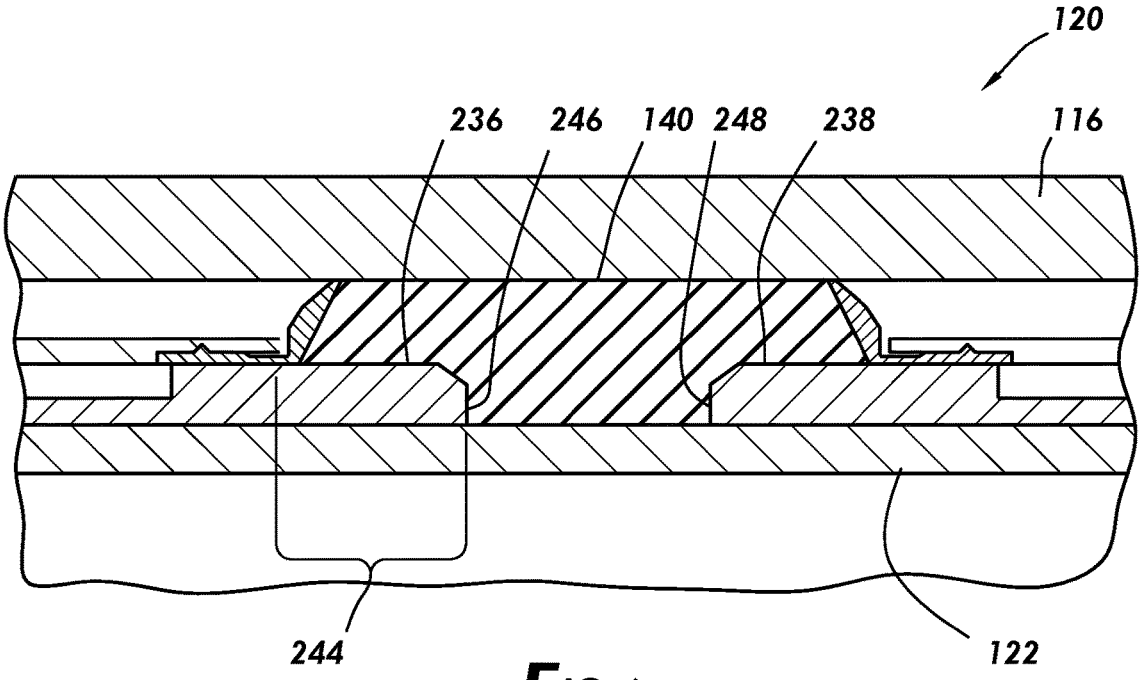
FIG. 6 is an enlarged view of the set packer with an alternate prop geometry including blunt or squared props.

FIG. 6 is an enlarged view of the packer with an alternative prop geometry. The props 236, 238 in this example have blunt or generally squared ends 246, 248 (with a slight bevel) instead of the ramped or wedge-shaped ends of FIG. 5. Even without wedge-shaped or ramped ends to separate the sealing element 140 from the mandrel 122, the blunt ends 246, 248 are still able to compress the sealing element 140 axially inwardly to deform it radially outwardly into sealing engagement with the casing 116. Other example geometries could include concave prop ends.

An advantage of a controlled-volume gland opening according to this disclosure is that the sealing element may be reliably deformed to a greater extent than with prior sealing tools. This allows the thickness of the sealing element to be reduced for a given set of packer and casing constraints, while still providing an acceptable amount of expansion. As a result, a thinner overall tool profile may also be achieved, and/or, a greater flow volume may be attained around the packer between an OD of the packer and an ID of the wellbore. In some embodiments, a radial thickness of the sealing element may be less than or equal to a radial spacing between an outer diameter of the sealing element and an inner diameter of the portion of the well to be sealed.

Figures 7, 8:
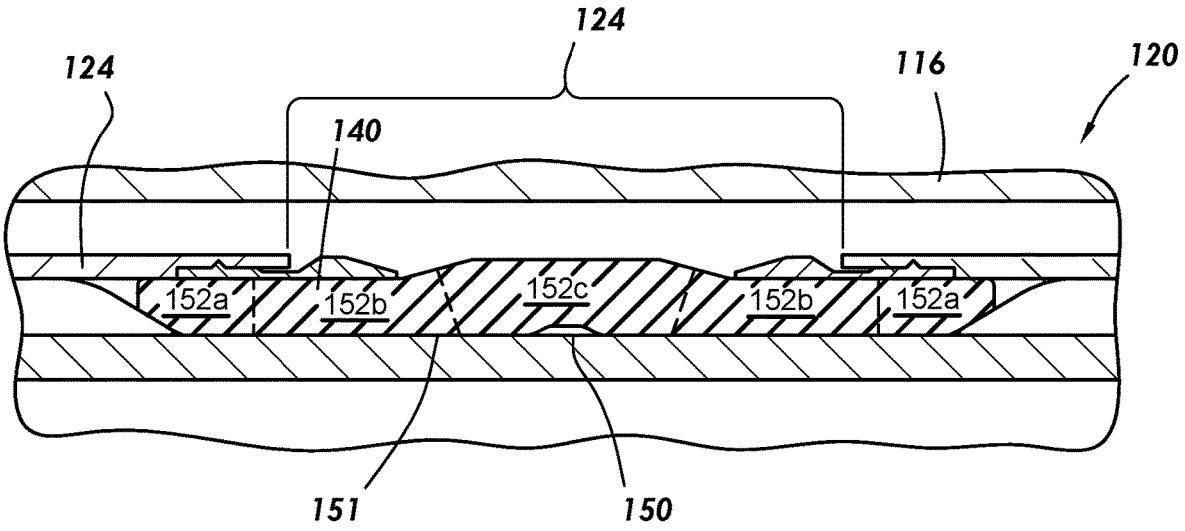
FIG. 7 is a table comparing squeeze ratio for two elements having the same volume but different thicknesses, when set between a given mandrel OD and casing ID.
FIG. 8 is an example of a sealing element made from elastomers of different durometers along its length.

To illustrate the effect of changing the element thickness, FIG. 7 is a chart comparing two alternative sealing elements Element 1 and Element 2 for a given Mandrel OD and Casing ID. This example assumes a Mandrel OD of 4.55 inches (~11.6 cm) and a Casing ID of 6.25 inches (~15.9 cm). Element 1 and Element 2 may have the same Element ID (4.55 in. or ~11.6 cm) to fit on the mandrel. The volume of the two elements is also the same (42 in.$^3$). However, Element 2 is thinner, which gives it a smaller Element OD of 5.3 inches (~13.5 cm), compared to an Element OD of 5.8 (~14.7 cm) inches for Element 1. To achieve the same volume of 42 in.$^3$, Element 2 has a longer run-in (relaxed) length of 7.24 inches (~18.4 cm) versus a run-in length of 4.13 inches (~10.5 cm) for Element 1. As a result, the squeeze ratio of Element 2 is approximately 60%, while the squeeze ratio of Element 1 is approximately 30%. A conventional sealing element might fail with a percent squeeze significantly greater than 30%. However, the controlled-volume gland opening and other aspects allow for greater expansion. In some examples, the sealing element allows a percent squeeze in a range of greater than 35% and up to 60%. Thus, the thinner Element 2 may seal as well expanded into the controlled-volume gland opening as thicker Element 1 would seal in a conventional packer application, despite the larger squeeze ratio. The thinner element has numerous advantages since the sealing element may have an outer diameter less than or equal to an outer diameter of the shroud in a run-in configuration prior to setting.

FIGS. 8 to 11 provide further example configurations of sealing elements with different combinations of optional features, such as variable-durometer, face angles, undercuts, garter spring placement, fillers, and so forth, to tune the expansion for particular packer configuration and application. The examples of FIGS. 8 to 11 are generally not to scale and unless otherwise noted or claimed are not intended to limit the geometry to what is shown. These features may be combined with any of the foregoing features in other example embodiments, to form a sealing element that may be expanded into a controlled-volume gland opening as disclosed herein.

FIG. 8 is an example of a sealing element 140 made from elastomers of different durometers along its length. Generally, an element may be formed with a higher durometer at locations where it benefits from more stiffness, and a lower durometer where it needs to be more compliant such as at preferential bending locations. In this example, a first, outer zone 152*a* may be formed from an elastomer with a higher durometer, for stiffness where the sealing element 140 is captured under the shroud 124. A second zone 152*b* may be formed from an elastomer having a lower durometer to preferentially buckle around the ends of the shroud 124. A third zone 152 may be formed from an elastomer with an even lower durometer, to help deform into sealing engagement with the casing 116.

Different methods may be used to form the sealing element 140 with multiple durometers. Generally, the different zones 152 may be created by varying the elastomer along its length at some stage during its manufacture. For example, the sealing element 140 may be formed by arranging elastomers of different durometers in the zones 152*a*, 152*b*, 152*c*, and bonding, molding, or otherwise joining them. One method may involve arranging uncured material compounds at different locations, such as with ends of one durometer (e.g. a harder material) and a center portion of another durometer (e.g. a softer material). The materials may be arranged in an uncured and pre-formed condition to some degree, and then compression molded to form a unitary sealing element of varying durometer. The elements can be molded in a three-piece compression mold or a multiple-piece vertical-compression mold. Once the sealing element 140 is molded it may be post-cured within the mold. Curing the molded elastomer pieces in this manner allows the physical properties to get locked in in the confined state. Based upon the complexity of the design of the sealing element 140, a multiple piece vertical compression mold may allow for better volume displacement and minimize the appearance of any mold line.

Referring still to FIG. 8, one or more under cuts 150 are optionally provided along the sealing element 140 to help the sealing element 140 preferentially deform in the vicinity of the under cuts 150. In this example, a central under cut is provided on the inner surface 151 of the sealing element 140 to encourage the elastomer to preferentially deform at the center. The central location of the under cut helps ensure the sealing element 140 contacts the casing 116 in the center of the gland opening 130. This may help ensure a reliable seal with the casing 116 by purging any fluid out of the area between the well bore from the middle of the elements towards the ends of the element package during deployment to avoid trapping fluid and causing a hydraulic lock.

Figure 9:
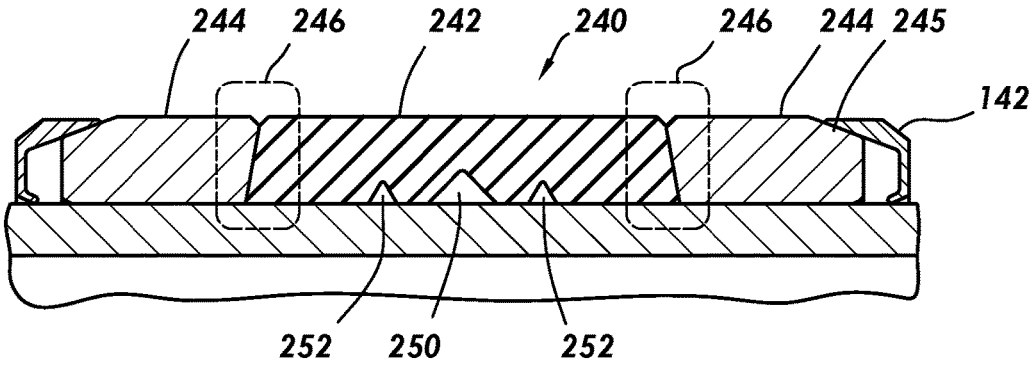
FIG. 9 is an alternative example embodiment of a sealing element made from elastomers of different durometers, along with face angles and undercuts to provide consistent/reliable deployment.

FIG. 9 is an example of a sealing element 240 using face angles and undercuts to provide consistent/reliable deployment. The sealing element 240 is depicted as comprising separate elements, which may be formed of different durometers, and may be bonded, molded, or otherwise joined into a unitary sealing element as discussed above. A central element 242 may be formed of a first, relatively low-durometer elastomer. Two outer elements 244 may be formed from a second, higher-durometer elastomer. The elements 242, 244 are arranged end-to-end at bonding locations 246. The run-in OD of the central element 242 and outer elements 244 are approximately the same. The outer elements 244 included beveled ends 245 that generally align with a relaxed position of the backup shoes 142. The central element 242 also includes another example of undercuts including a central, larger undercut 250 and smaller outer cuts 252.

Figure 10:
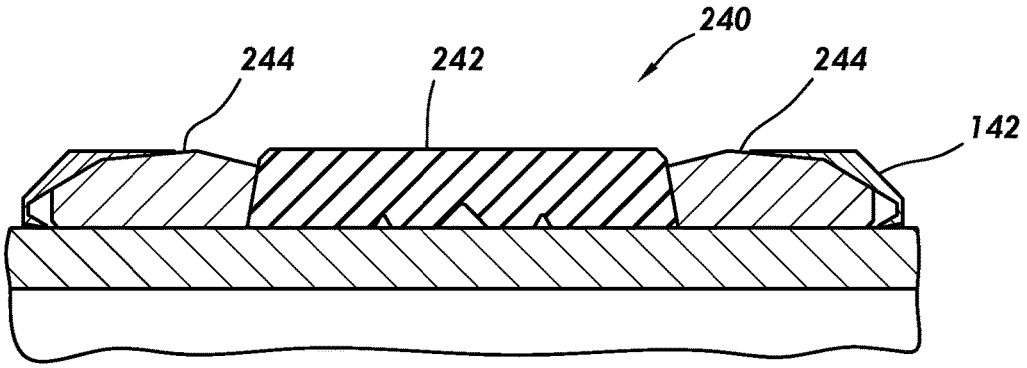
FIG. 10 is another example of a multi-durometer sealing element configured for a higher flow rate (swab rate).

FIG. 10 is another example configuration of multi-durometer sealing element configured for a higher flow rate (swab rate). The central element 242 may again be formed of a different durometer elastomer than the two outer elements 244. The elements 242, 244 are still arranged end-to-end at bonding locations 246. However, the run-in OD of the central element 242 is larger than the reduced-diameter OD of the outer elements 244. The end elements 244 are proportionally longer than in FIG. 9, and the backup shoes 142 are correspondingly longer.

Figure 11:
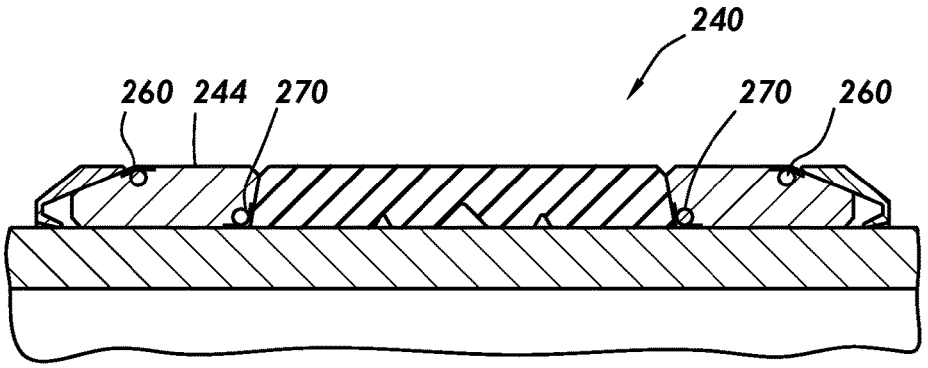
FIG. 11 is another example of a three-piece, multi durometer sealing element, modified/adjusted with garter springs at selected locations to aid in deployment.

FIG. 11 is another example of another multi-durometer sealing element 240, modified/adjusted with garter springs at selected locations 260 and 270 to aid in deployment. The garter springs may take the place of the backup shoes at locations 260. The garter springs at locations 270 may be used to help retain the end elements 244.

Accordingly, each of the foregoing examples of the present disclosure may provide a sealing element that is expandable outwardly into a controlled-volume gland opening. A greater percentage squeeze may therefore be achieved for a given element thickness. This may allow for a more reliable expansion and a slimmer tool profile with greater flow area between the sealing tool and the wellbore, and/or greater expansion with less material. The systems and methods of the present disclosure may additionally include any of the various features disclosed herein, in any viable combination, including but not limited to any combination of the features discussed in the examples above and in any of the following statements.

Statement 1. A sealing tool, comprising: a mandrel for lowering into a well and supporting one or more sealing tool components thereon; a shroud disposed about the mandrel, the shroud including an upper portion and a lower portion axially spaced apart on the mandrel to define a gland opening there between; a sealing element spanning the gland opening and including a first end captured between the mandrel and the upper portion of the shroud and a second end captured between the mandrel and the lower portion of the shroud; and first and second props between the mandrel and the shroud, axially moveable to engage the sealing element and urge the sealing element radially outwardly into a controlled volume defined at the gland opening between the mandrel and a portion of the well to be sealed.

Statement 2. The sealing tool of Statement 1, wherein each prop has a wedge-shaped end angled radially outwardly to wedge between the mandrel and the sealing element as the props are axially moved toward one another.

Statement 3. The sealing tool of Statement 1 or 2, further comprising: one or more backup shoes disposed between the sealing element and ends of the upper and lower shroud portions.

Statement 4. The sealing tool of any of Statements 1 to 3, wherein a radial thickness of the sealing element is less than or equal to a radial spacing between an outer diameter of the sealing element and an inner diameter of the portion of the well to be sealed.

Statement 5. The sealing tool of any of Statements 1 to 4, wherein the sealing element has a percent squeeze in a range of 35% to 60% when sealingly engaged with the portion of the well to be sealed.

Statement 6. The sealing tool of any of Statements 1 to 5, wherein the sealing element has an outer diameter less than or equal to an outer diameter of the shroud in a run-in configuration prior to setting.

Statement 7. The sealing tool of any of Statements 1 to 6, further comprising: an axially varying sealing element durometer, one or more under cuts, a garter spring, a filler, a mesh material, or combinations thereof, to preferentially deform the sealing element at one or more desired locations in response to axial compression.

Statement 8. The sealing tool of any of Statement 1 to 7, wherein the sealing element is unitarily formed as a single elastomer comprising at least two zones of different durometer.

Statement 9. The sealing tool of any of Statements 1 to 8, wherein the sealing element comprises a central element having a first durometer and outer elements formed of at least a second durometer, wherein the central element and outer elements are separately formed.

Statement 10. The sealing tool of Statement 9, wherein the outer elements have a smaller OD than the central element.

Statement 11. A method, comprising: lowering a sealing tool into a well, including a sealing element captured between upper and lower portions of a shroud axially spaced apart on the mandrel to define a gland opening therebetween; and axially moving first and second props between the mandrel and the shroud to engage the sealing element and urge the sealing element radially outwardly at the gland opening into sealing engagement with a portion of the well to be sealed.

Statement 12. The method of Statement 11, further comprising: wedging wedge-shaped ends of the props between the mandrel and the sealing element to urge the sealing element radially outwardly.

Statement 13. The method of any of Statements 11 or 12, further comprising: protecting the sealing element with one or more backup shoes disposed between the sealing element and ends of the upper and lower shroud portions.

Statement 14. The method of any of Statements 11 to 13, wherein a radial thickness of the sealing element is less than or equal to a radial spacing between an outer diameter of the sealing element and an inner diameter of the portion of the well to be sealed.

Statement 15. The method of any of Statements 11 to 14, further comprising compressing the sealing element into sealing engagement with the portion of the well to be sealed with a percent squeeze in the range of 35% to 60%.

Statement 16. The method of any of Statements 11 to 15, wherein the sealing element has an outer diameter less than or equal to an outer diameter of the shroud in a run-in configuration prior to setting.

Statement 17. A method of forming a sealing tool, comprising: positioning a shroud about a mandrel, the shroud including an upper portion and a lower portion axially spaced apart on the mandrel to define a gland opening therebetween; positioning a sealing element on the mandrel spanning the gland opening, including capturing a first end between the mandrel and the upper portion of the shroud and a second end between the mandrel and the lower portion of the shroud; and axially engaging the sealing element to urge the sealing element radially outwardly into a controlled volume defined at the gland opening between the mandrel and a portion of the well to be sealed.

Statement 18. The method of Statement 17, further comprising: forming the sealing element with a variable durometer.

Statement 19. The method of any of Statements 17 or 18, further comprising unitarily forming the sealing element as a single elastomer comprising at least two zones of different durometer.

Statement 20. The method of any of Statements 17 to 19, further comprising: forming a central element having a first durometer; forming outer elements of at least a second durometer different than the first durometer; and bonding the outer elements at opposing ends of the central element.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A sealing tool, comprising:

a mandrel supporting one or more sealing tool components thereon;

a shroud disposed about the mandrel, the shroud including an upper portion and a lower portion axially spaced apart on the mandrel to define a gland opening there between;

a sealing element spanning the gland opening and including a first end captured between the mandrel and the upper portion of the shroud and a second end captured between the mandrel and the lower portion of the shroud; and first and second props between the mandrel and the shroud and axially moveable to engage the sealing element and urge the sealing element radially outwardly into a controlled volume defined at the gland opening between the mandrel and a portion of the well to be sealed, wherein the controlled volume and a length of the gland opening into which the sealing element expands remain constant during expansion.

2. The sealing tool of claim 1, wherein each prop has a wedge-shaped end angled radially outwardly to wedge between the mandrel and the sealing element as the props are axially moved toward one another.

3. The sealing tool of claim 1, further comprising:

one or more backup shoes disposed between the sealing element and ends of the upper and lower shroud portions.

4. The sealing tool of claim 1, wherein a radial thickness of the sealing element is less than or equal to a radial spacing between an outer diameter of the sealing element and an inner diameter of the portion of the well to be sealed.

5. The sealing tool of claim 1, wherein the sealing element has a percent squeeze in a range of 35% to 60% when sealingly engaged with the portion of the well to be sealed.

6. The sealing tool of claim 1, wherein the sealing element has an outer diameter less than or equal to an outer diameter of the shroud in a run-in configuration prior to setting.

7. The sealing tool of claim 1, further comprising:

an axially varying sealing element durometer, one or more under cuts, a garter spring, a filler, a mesh material, or combinations thereof, to preferentially deform the sealing element at one or more desired locations in response to axial compression.

8. The sealing tool of claim 1, wherein the sealing element is unitarily formed as a single elastomer comprising at least two zones of different durometer.

9. The sealing tool of claim 1, wherein the sealing element comprises a central element having a first durometer and outer elements formed of at least a second durometer, wherein the central element and outer elements are separately formed.

10. The sealing tool of claim 9, wherein the outer elements have a smaller outer diameter than the central element.

11. A method, comprising:

lowering a sealing tool into a well, including a sealing element captured between upper and lower portions of a shroud axially spaced apart on the mandrel to define a controlled volume gland opening therebetween; and axially moving first and second props between the mandrel and the shroud to engage the sealing element and urge the sealing element radially outwardly at the gland opening into sealing engagement with a portion of the well to be sealed while holding constant the controlled volume and a length of the gland opening constant into which the sealing element expands.

12. The method of claim 11, further comprising:

wedging wedge-shaped ends of the props between the mandrel and the sealing element to urge the sealing element radially outwardly.

13. The method of claim 11, further comprising:

protecting the sealing element with one or more backup shoes disposed between the sealing element and ends of the upper and lower shroud portions.

14. The method of claim 11, wherein a radial thickness of the sealing element is less than or equal to a radial spacing between an outer diameter of the sealing element and an inner diameter of the portion of the well to be sealed.

15. The method of claim 11, further comprising compressing the sealing element into sealing engagement with the portion of the well to be sealed with a percent squeeze in the range of 35% to 60%.

16. The method of claim 11, wherein the sealing element has an outer diameter less than or equal to an outer diameter of the shroud in a run-in configuration prior to setting.

17. A method of forming a sealing tool, comprising:

positioning a shroud about a mandrel, the shroud including an upper portion and a lower portion axially spaced apart on the mandrel to define a gland opening therebetween;

positioning a sealing element on the mandrel spanning the gland opening, including capturing a first end between the mandrel and the upper portion of the shroud and a second end between the mandrel and the lower portion of the shroud; and axially engaging the sealing element to urge the sealing element radially outwardly into a controlled volume defined at the gland opening between the mandrel and a portion of the well to be sealed while holding constant the controlled volume and a length of the gland opening constant into which the sealing element expands.

18. The method of claim 17, further comprising:

forming the sealing element with a variable durometer.

19. The method of claim 18, further comprising unitarily forming the sealing element as a single elastomer comprising at least two zones of different durometer.

20. The method of claim 17, further comprising:

forming a central element having a first durometer;

forming outer elements of at least a second durometer different than the first durometer; and bonding the outer elements at opposing ends of the central element.

* * * * *